US012035804B2

(12) United States Patent
Eckert et al.

(10) Patent No.: US 12,035,804 B2
(45) Date of Patent: Jul. 16, 2024

(54) KITCHEN FURNITURE ITEM HAVING A VARIABLE WORKTOP OR TABLETOP

(71) Applicant: Bulthaup GMBH & CO. KG, Bodenkirchen (DE)

(72) Inventors: Marc Oliver Eckert, Bodenkirchen (DE); Ulrich Spohde, Bodenkirchen (DE)

(73) Assignee: Bulthaup GMBH & CO. KG, Bodenkirchen (DE)

( * ) Notice: Subject to any disclaimer, the term of this patent is extended or adjusted under 35 U.S.C. 154(b) by 717 days.

(21) Appl. No.: 17/269,862

(22) PCT Filed: Aug. 20, 2019

(86) PCT No.: PCT/EP2019/072197

§ 371 (c)(1),
(2) Date: May 24, 2021

(87) PCT Pub. No.: WO2020/038908

PCT Pub. Date: Feb. 27, 2020

(65) Prior Publication Data

US 2021/0267362 A1 Sep. 2, 2021

(30) Foreign Application Priority Data

Aug. 21, 2018 (DE) ..... 10 2018 120 369.1

(51) Int. Cl.
*A47B 31/02* (2006.01)
*A47B 13/08* (2006.01)
(Continued)

(52) U.S. Cl.
CPC ..... *A47B 31/02* (2013.01); *A47B 13/08* (2013.01); *A47B 33/00* (2013.01); *A47B 77/022* (2013.01);
(Continued)

(58) Field of Classification Search
CPC ..... A47B 31/02; A47B 13/08; A47B 33/00; A47B 77/022; A47B 2031/002;
(Continued)

(56) References Cited

FOREIGN PATENT DOCUMENTS

DE 19746126 A1 * 4/1998 ..... A47B 77/02
DE 19746126 B4 * 3/2004 ..... A47B 77/02
(Continued)

OTHER PUBLICATIONS

International Search Report and Written Opinion, PCT/EP2019/072197. European Patent Office, mailed Oct. 7, 2019.

*Primary Examiner* — Emmanuel E Duke
(74) *Attorney, Agent, or Firm* — MARSHALL, GERSTEIN & BORUN LLP

(57) ABSTRACT

The invention relates to a kitchen furniture item having a horizontal worktop or tabletop and a substructure which holds the worktop, wherein the worktop or tabletop is built up in modular fashion from at least two panel parts which are releasably connected to one another along common lateral edges, wherein at least one of the panel parts is a functional panel part which is provided with a treatment. The invention further relates to a method for integrating a functional panel part into a worktop or tabletop of such a kitchen furniture item and to a method for replacing one panel part of a worktop or tabletop of such a kitchen furniture item with another panel part.

20 Claims, 3 Drawing Sheets

Figure 1A:
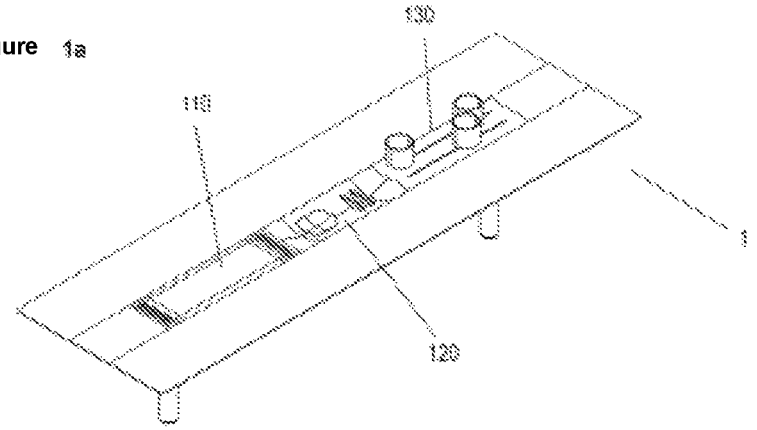

(51) Int. Cl.

| | |
|---|---|
| ***A47B 33/00*** | (2006.01) |
| ***A47B 77/02*** | (2006.01) |
| ***F25B 21/04*** | (2006.01) |
| *A47B 31/00* | (2006.01) |

(52) U.S. Cl.
CPC ..... *F25B 21/04* (2013.01); *A47B 2031/002* (2013.01); *A47B 2200/0009* (2013.01); *A47B 2220/0077* (2013.01)

(58) Field of Classification Search
CPC .... A47B 2200/0009; A47B 2220/0077; A47B 13/14; F25B 21/04
See application file for complete search history.

(56) References Cited

FOREIGN PATENT DOCUMENTS

| | | | | | |
|---|---|---|---|---|---|
| EP | 2727495 | A1 | | 5/2014 | |
| ES | 2280982 | T3 | * | 9/2007 | ..... F24C 15/18 |
| FR | 2886528 | A1 | | 12/2006 | |
| JP | 2005245980 | A | * | 9/2005 | |
| KR | 200400119 | Y1 | | 11/2005 | |
| KR | 100592479 | B1 | * | 6/2006 | |

* cited by examiner

KITCHEN FURNITURE ITEM HAVING A VARIABLE WORKTOP OR TABLETOP

The invention relates to a piece of kitchen furniture having a horizontal worktop or tabletop and a subframe that holds the worktop.

Piece of kitchen furniture of the category are known in the most varied embodiments from the prior art. For example, sideboards or dining tables and worktables that have a horizontal worktop or tabletop are typically arranged in domestic kitchens.

The worktops or tabletops can also be provided with various functional elements, for example with cooktops, sinks, or the like. The configuration of the work surfaces is, however, always rigid and cannot be variably adapted to special needs of a customer either at the side of the manufacturer or at the side of the user without having to make use of expensive customized products.

It is the object of the invention to produce a piece of kitchen furniture having a worktop or tabletop that has a high degree of flexibility in the adaptation to special needs of a customer at the side of the manufacture or at the side of the user.

Against this background, the invention relates to a piece of kitchen furniture having a horizontal worktop or tabletop and a subframe that holds the worktop, wherein the worktop or tabletop is built up in modular form of at least two panel parts that are releasably connected to one another along common side edges, with at least one of the panel parts being a functional panel part that is provided with an application.

Non-functional, simple panel parts can be assembled with different functional panel parts in an individual manner to form a worktop or tabletop that is variably configured overall.

The term of piece of kitchen furniture is to be understood in the present connection in the sense of any desired piece of furniture that is intended for disposal in a private or gastronomic kitchen. The worktop or tabletop can, for example, be the worktop of a fitted kitchen or the tabletop of a freestanding kitchen work table. The piece of kitchen furniture further comprises a subframe, that holds the worktop or tabletop in position, in addition to the furniture board.

At least one other of the panel parts is preferably a non-functional panel part that is provided with an application. The non-functional panel part can, for example, be a simple wooden panel that is provided with connection elements for connecting to other panel parts.

The worktop or tabletop further preferably comprises two or more functional panel parts and two or more non-functional panel parts. For example, a series of two or more, for example three, functional panel parts can be enclosed like a sandwich between two longer, non-functional panel parts on the worktop or tabletop.

Provision is made in an embodiment that the functional panel parts comprise one or more of the following applications: a heating device, a cooling device, lighting, a holding device, a water supply, a tub, holders for kitchen appliances, or guide rails for displaceable elements.

For example, at least one functional panel part can comprise a temperature control panel that preferably has both a cooling function and a heating function. A module for temperature control can, for example, be arranged at the lower side of such a panel part, more precisely below the temperature control panel, that comprises a Peltier element that can be operated for both heating and cooling the panel. The module for controlling the Peltier element can furthermore comprise a sensor that is configured, for example, such that it can detect the presence of a magnet in a detection region of the work surface, with the Peltier element being energized on detection or on movement of a magnet in the detection region. A rod-shaped, magnetic control element can, for example, also be associated with the upper side of the module and its rotational position of the sensor in the detection zone is decisive for the current level and the current direction and therefore for the question of how much the region is heated or cooled.

At least one functional panel part can furthermore comprise a tub with holders comprising removably held accessories. For example, the table can be adapted for the consumption off sushi in that small bowls and portioning tools for wasabi and soy sauce are provided as removable and therefore washable accessories. This panel part can furthermore likewise comprise a temperature control module to be able to heat or cool individual accessories, with the temperature control module being able to be configured as just described.

At least one functional panel part can furthermore comprise guide rails for displaceable elements. The displaceable elements can, for example, be holders for napkins, flatware, or chopsticks. These elements can be variably moved into a position easily within reach of all the persons seated at the table by displacement.

The releasable connection between the panel parts of the worktop or tabletop can be a shaped-matched connection. Provision can be made in this respect that the common side edges comprise dovetail grooves that are engaged behind by reversibly expandable sliding blocks. The sliding blocks can, for example, be spread apart by a screw in a direction extending substantially normally to the board plane to reversibly clamp the panel parts.

The piece of kitchen furniture is mobile or movable in accordance with an embodiment. The piece of kitchen furniture can, for example, be a trolley or a similar mobile piece of kitchen furniture. In principle, however, stationary or also fixedly installed pieces of kitchen furniture are also covered by the present invention.

With a piece of kitchen furniture in accordance with the invention, the at least two panel parts are preferably connected to one another such that the at least two panel parts are arrangeable or arranged beside one another, below one another, or above one another. For example, the functional panel part can be displaceably arranged relative to the other panel part of the at least two panel parts so that the panel parts can be arranged above one another or below one another.

The at least two panel parts are furthermore preferably formed from different materials. A particularly high quality appearance can be achieved by this design. For example, one panel part can be produced from wood and the other panel part from marble. This choice of the material is as desired and can be flexibly adapted to the respective demands. Wood, stone, metal, or also plastic can be used, for example.

Against the initially named background, the invention furthermore relates to a method of integrating a functional panel part into a worktop or tabletop of a piece of kitchen furniture in accordance with the invention, wherein the functional panel part is connected to at least one further panel part of the table. The method permits a worktop or tabletop to be assembled from a reservoir of prefabricated panel parts in agreement with individual needs of a customer.

In addition, the invention relates to a method of replacing a panel part of a worktop or tabletop of a piece of kitchen furniture in accordance with the invention with another panel part, with the removed and/or inserted panel part being a functional panel part. Worktops or tabletops of a piece of kitchen furniture in accordance with the invention can thus also be subsequently adapted if the needs of the customer subsequently change, for example due to renovation or moving.

Figure 3A:
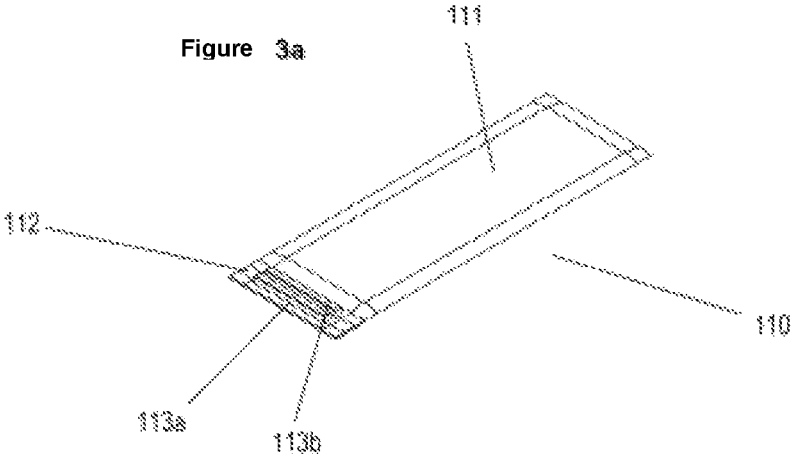
Figure 3B:
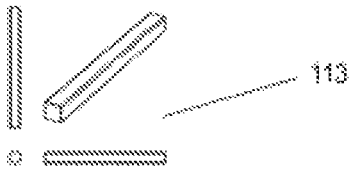
Figure 4A:
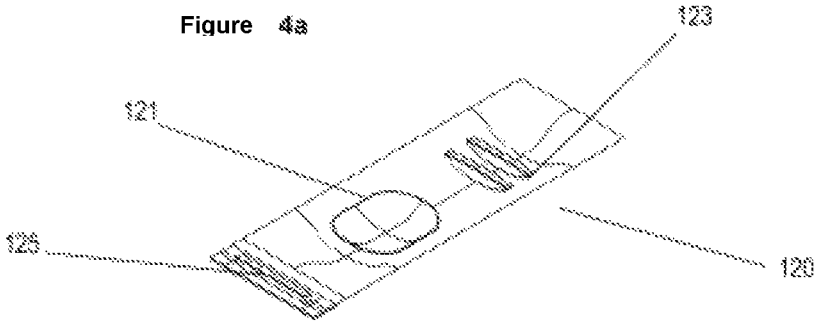
Figure 4B:
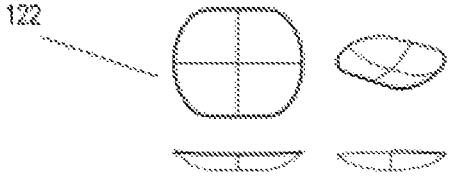
Figure 4C:
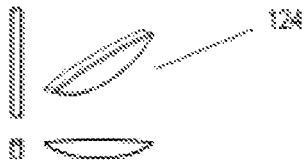
Figure 5A:
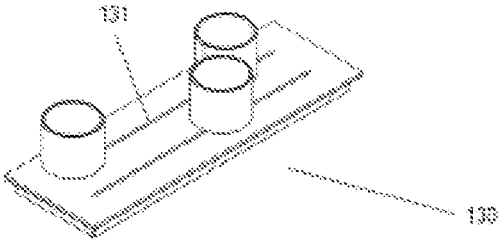
Figure 5B:
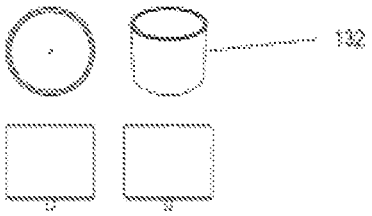

Further details and advantages of the invention result from the embodiments discussed in the following with reference to the Figures. There are shown in the Figures:

FIG. 1: views of a table configured in accordance with the invention that is configured as a preparation table and dining table for sushi;

FIG. 2: views of the functional panel parts of this table;

FIG. 3: an individual view of one of these functional panel parts;

FIG. 4: an individual view of a further one of these functional panel parts with associated accessories; and FIG. 5: an individual view of a yet other one of these functional panel parts with associated elements.

Figure 1B:
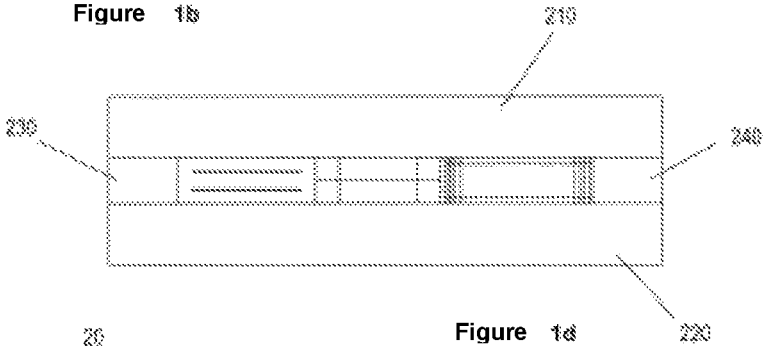
Figure 1C:
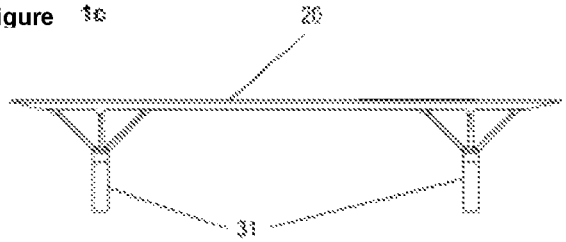
Figure 1D:
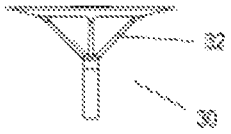

A piece of kitchen furniture configured in accordance with the invention in the form of a sushi table 1 is shown in different views in FIG. 1, with FIG. 1*a* showing a perspective view, FIG. 1*b* a plan view, FIG. 1*c* a side view of the longitudinal side, and FIG. 1*d* a side view of the short side of the table 1.

The table 1 generally comprises a tabletop 20 and a subframe 30 in the form of two table legs 31 having a plurality of struts 42 for holding the tabletop 10.

The tabletop 10 is composed in modular form of a plurality of panel parts, namely of three functional panel parts 110, 120, and 130 and four non-functional parts 210, 220, 230, and 240. Two of the non-functional panel parts 210 and 220 have the form of elongate boards and enclose the three functional panel parts 110, 120, and 130 arranged in series in the manner of a sandwich The two further ones of the non-functional panel parts 230 and 240 terminate the row of functional panel parts 110, 120, and 130 at both sides. The non-functional panel parts 210, 220, 230, and 240 can preferably be produced from wood.

The non-functional panel parts 210 and 220 are connected along their inwardly disposed longitudinal edges to a respective one longitudinal edge of all three functional panel parts 110, 120, and 130 and to the further non-functional panel parts 230 and 240 in a manner such that a subsequent release is made possible. Provision is made in this connection that the long side edges of all the panel parts 110, 120, 130, 210, 220, 230, and 240 each comprise dovetail grooves that are locally engaged behind at connection sites by sliding blocks that can be reversibly expanded using screws.

Figure 2A:
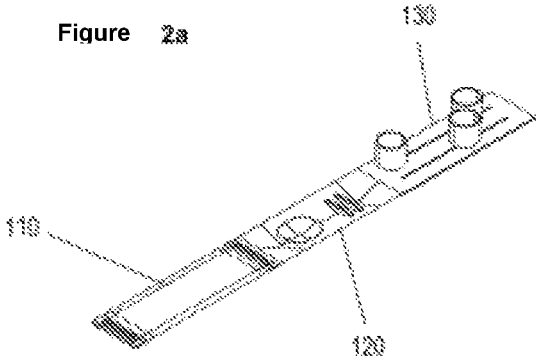
Figure 2B:
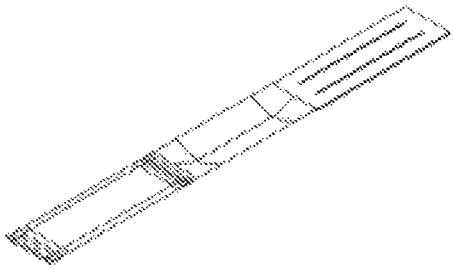

The middle part of the tabletop 10 consisting of the three functional panel parts 110, 120, an 130 arranged in series is shown in isolation in FIG. 2, once with associated accessories and elements (FIG. 2*a*) and once without (FIG. 2*b*).

The row here comprises a first panel part 110 at the left having a temperature control panel 111 that has both a cooling function and a heating function. A module for temperature control that comprises a Peltier element and a sensor element is arranged at the lower side of this panel part 110 in the region of the temperature control panel 111. The Pelter element can be operated both for heating and for cooling the temperature control panel 111 depending on the direction of energization. The sensor serves the control of the Peltier element, with it being able to detect the presence of a magnet in a detection region 112 of the panel surface and being able to energize the Peltier element on detection or after movement of a magnet in this detection region 112. Two magnetic rods 113*a* are provided as corresponding control elements and their rotational positions are decisive for the direction of the magnetic fields and therefore for the question of whether or by how much the region is heated (magnetic rod 113*a*) or cooled (magnetic rod 113*b*). The panel part 110 and one of the three magnetic rods 113 are shown in isolation in FIGS. 3*a* and 3*b*.

In the middle, the row further comprises a second panel part 120 having a depression 121 for inserting a tub 122 for soy sauce and holders 123 for tools 124 for portioning wasabi. A Peltier element such as described in connection with the first panel part 110 is arranged below the depression 121 to be able to selectively heat or cool the tub 122 and its content. The control of the Peltier element works as described in connection with the first panel part 110, with a control element also being provided in the form of a magnetic rod 135 here. The panel part 120 and the individual accessories 122 and 124 are shown in isolation in FIGS. 4*a-c*.

Finally, the row comprises at the right a third panel part 130 having guide rails 131 for displaceable holding elements 132 that can serve the storage of napkins, flatware, or chopsticks. These holding elements 132 can be variably moved into a position easily within reach of all the persons seated at the table by displacement along the guide rails 131. The panel part 130 and an individual one of the holding elements 132 are shown in isolation in FIGS. 5*a-c*.

The sushi table 1 has a high degree of flexibility and can be adapted to special needs of a customer both at the manufacturer's side by a specific assembly of the panel parts 110, 120, 130, 210, 220, 230, and 240 and subsequently at the user side by a replacement of one or more panel parts 110, 120, 130, 210, 220, 230, and 240.

The invention claimed is:

1. A piece of kitchen furniture having a horizontal worktop or tabletop and a subframe that holds the worktop, wherein the worktop or tabletop comprises at least two panel parts that are releasably connected to one another along common side edges, with at least one of the panel parts being a functional panel part that is provided with an application.

2. The piece of kitchen furniture in accordance with claim 1, wherein at least one other of the panel parts is a non-functional panel part that is provided with an application.

3. The piece of kitchen furniture in accordance with claim 1, wherein the worktop or tabletop comprises two or more functional and two or more non-functional panel parts.

4. The piece of kitchen furniture in accordance with claim 1, wherein the functional panel parts comprise one or more of the following applications: a heating device, a cooling device, lighting, a holding device, a water supply, a tub, holders for kitchen appliances, or guide rails for displaceable elements.

5. The piece of kitchen furniture in accordance with claim 1, wherein at least one functional panel part comprises a temperature control panel that has both a cooling function and a heating function.

6. The piece of kitchen furniture in accordance with claim 5, further comprising a Peltier element coupled to a side of the temperature control panel.

7. The piece of kitchen furniture in accordance with claim 6, further comprising a sensor coupled to the Peltier element and a magnet, the sensor to sense a position of the magnet and to control a temperature of the Peltier element based on the position of the magnet.

8. The piece of kitchen furniture in accordance with claim 7, wherein the magnet comprises a magnetic rod.

9. The piece of kitchen furniture in accordance with claim 8, wherein a rotational position of the magnet rod is sensed by the sensor.

10. The piece of kitchen furniture in accordance with claim 7, wherein the magnet comprises a plurality of magnetic rods.

11. The piece of kitchen furniture in accordance with claim 10, wherein one of the plurality of magnetic rods is associated with reducing a temperature of the Peltier element and another one of the plurality of magnetic rods is associated with increasing a temperature of the Peltier element.

12. The piece of kitchen furniture in accordance with claim 1, wherein at least one functional panel part comprises a tub having holders with removably held accessories.

13. The piece of kitchen furniture in accordance with claim 1, wherein at least one functional panel part comprises guide rails for displaceable elements.

14. The piece of kitchen furniture in accordance with claim 1, wherein the releasable connection between the panel parts of the worktop or tabletop is a shape-matched connection, with provision being made that the common side edges comprise dovetail grooves that are engaged behind by reversibly expandable sliding blocks.

15. The piece of kitchen furniture in accordance with claim 1, the piece of kitchen furniture is mobile and is a trolley.

16. The piece of kitchen furniture of claim 1, wherein the at least two panel parts are connected to one another such that the at least two panel parts are arrangeable or arranged beside one another, below one another, or above one another.

17. The piece of kitchen furniture in accordance with claim 1, wherein at least two panel parts are formed from different materials.

18. A method of integrating a functional panel part into the worktop or tabletop of a piece of kitchen furniture in accordance with claim 1, comprising connecting the functional panel part to at least one further panel part of the tabletop.

19. A method of replacing a panel part of a worktop or tabletop of a piece of kitchen furniture in accordance with claim 1, comprising removing the panel part and inserting another panel part, wherein the removed panel part and/or inserted panel part is a functional panel part.

20. The piece of kitchen furniture in accordance with claim 1, wherein at least one functional panel part comprises a temperature control panel that has both a cooling function and a heating function and wherein that at least one functional panel part comprises a tub having holders with removably held accessories.

* * * * *